US007594514B2

(12) United States Patent
Fereghetti et al.

(10) Patent No.: US 7,594,514 B2
(45) Date of Patent: Sep. 29, 2009

(54) UNIVERSAL ADJUSTABLY POSITIONABLE MASKING PANEL SYSTEM, APPARATUS AND KIT, AND METHOD OF USING SAME

(75) Inventors: John Fereghetti, Grand Blanc, MI (US); Scott D. Lee, Lapeer, MI (US); Jeffrey A. Pestrue, St. Louis, MI (US); Robert Butcher, Flushing, MI (US)

(73) Assignee: Eastman Holding Company, Flushing, MI (US)

( * ) Notice: Subject to any disclaimer, the term of this patent is extended or adjusted under 35 U.S.C. 154(b) by 349 days.

(21) Appl. No.: 11/320,171

(22) Filed: Dec. 28, 2005

(65) Prior Publication Data

US 2007/0144569 A1 Jun. 28, 2007

(51) Int. Cl.
*E04H 15/04* (2006.01)

(52) U.S. Cl. ..... 135/90

(58) Field of Classification Search ..... 135/117, 135/147, 21, 28, 90, 901, 96, 99, 98; 248/229.23, 248/276.1, 227.3, 219.4, 230.1, 230.8; 43/1, 43/2, 3

See application file for complete search history.

(56) References Cited

U.S. PATENT DOCUMENTS

| | | | | | |
|---|---|---|---|---|---|
| 1,167,767 | A | * | 1/1916 | Lindsey et al. | 135/147 |
| 1,280,013 | A | * | 9/1918 | Goddard | 248/181.1 |
| 2,560,556 | A | | 7/1951 | Creedon | |
| 2,710,609 | A | | 6/1955 | Giller | |
| 3,810,482 | A | | 5/1974 | Beavers | |
| 4,491,435 | A | | 1/1985 | Meier | |
| 4,941,499 | A | * | 7/1990 | Pelsue et al. | 135/125 |
| 4,974,575 | A | * | 12/1990 | Mitchell | 124/88 |
| 4,974,986 | A | | 12/1990 | Cook | |
| 5,214,872 | A | | 6/1993 | Buyalos, Jr. | |
| 5,613,512 | A | | 3/1997 | Bean | |
| 5,628,338 | A | * | 5/1997 | Stumbo | 135/147 |
| 5,738,129 | A | | 4/1998 | Vogt | |
| 5,845,885 | A | | 12/1998 | Carnevali | |
| 5,937,881 | A | * | 8/1999 | Villa | 135/20.1 |
| 5,944,041 | A | | 8/1999 | Kitchens | |
| 6,202,665 | B1 | | 3/2001 | O'Hare | |
| 6,220,556 | B1 | | 4/2001 | Sohrt et al. | |
| 6,296,005 | B1 | * | 10/2001 | Williams et al. | 135/98 |
| 6,296,415 | B1 | | 10/2001 | Johnson et al. | |
| 6,510,922 | B1 | | 1/2003 | Hodnett | |
| 6,575,653 | B1 | * | 6/2003 | Krauter | 403/55 |

(Continued)

*Primary Examiner*—David Dunn
*Assistant Examiner*—Noah Chandler Hawk
(74) *Attorney, Agent, or Firm*—Carrier, Blackman & Associates, P.C.; William D. Blackman; Joseph P. Carrier

(57) ABSTRACT

A concealment system includes one or more independently positionable masking panels. Each of the panels is independently supported by a hub and strut frame, and employs various interchangeable camouflage sheet materials. A polygonal perimeter strip has strut-engaging pockets thereon with a pocket located at each corner of the panel, and structure for mounting a masking panel thereon. Dual ball mount are attached to a platform and to a base portion of the frame hub, respectively. A positioning arm, having independently adjustable socket clamps, extends between the two ball mount to support the panel frame. An improved hub design eliminates guide channels therein, and employs cabling to attach the struts. The positioning arm has a single span with socket clamps permanently attached to each end so that each clamp can be independently adjusted.

10 Claims, 14 Drawing Sheets

U.S. PATENT DOCUMENTS 6,776,179 B1 * 8/2004 Chen ..... 135/147
6,904,923 B2 * 6/2005 Chai et al. ..... 135/88.09
7,090,181 B2 * 8/2006 Biba et al. ..... 248/288.31

* cited by examiner

UNIVERSAL ADJUSTABLY POSITIONABLE MASKING PANEL SYSTEM, APPARATUS AND KIT, AND METHOD OF USING SAME

BACKGROUND OF THE INVENTION

1. Field of the Invention

The present invention relates to a system, apparatus and kit for providing concealment to a hunter or naturalist in an outdoor setting, which helps conceal a user thereof from game or other wildlife. The system, apparatus and kit hereof includes one or more concealment apparatus, where the apparatus includes a masking panel, a positioning arm, and a mounting support for attachment to a support substrate. More particularly, the present invention relates to a masking system, apparatus and kit, in which each concealment apparatus includes an adjustable positioning arm having dual, independently adjustable ball-and-socket clamps. The system, apparatus and kit hereof, when used with an outdoor platform such as a tree stand or a boat, provide a simplified method and apparatus for concealing a user from nearly any selected angle.

2. Description of the Background Art

Hunting blinds are normally developed for specific applications. For instance, there are distinct and separate types of blinds designed for tree stands, boats, hunting chairs, and ground enclosures. This specificity can be problematic for hunters who enjoy multiple types of hunting experiences, since it could require a user to obtain a separate blind for each type of platform used. Some examples of blind structures for use with tree stands or other observation stands are described in U.S. Pat. Nos. 5,214,872, 5,613,512, 6,202,665, and 6,510,922.

A number of hub and strut systems have been known in the hunting and construction arts, and some of these systems have been applied to hunting blinds. Examples of some of the known hub and strut systems include those described in U.S. Pat. Nos. 3,810,482, 4,974,986, 5,738,129, 5,944,041, and 6,296,415.

Hubs known to the art generally include guiding or locking channels that position the struts at specific angles.

Similarly, a number of ball and socket positioning arms are known and used in a number of technical areas. Examples of some of the known ball and socket arms include those described in U.S. Pat. Nos. 5,845,885, 6,220,556, 2,560,556, 2,710,609, and 4,491,435.

Positioning arms known in the art generally employ a split or bifurcated arm design and a single adjustment mechanism for operating both socket clamps simultaneously. Products of this type are described in U.S. Pat. No. 5,845,885 to Camevali, and are sold by the RAM Mount Company of Seattle, Wash.

Although the known devices have some utility for their intended purposes, a need still exists in the art for a versatile kit and system of independently adjustable masking panels, which kit and system is adaptable for multiple outdoor concealment uses. A versatile concealment kit and system is needed, which could be used on more than one type of outdoor observation platform, in order to provide more versatility and flexibility than that encountered with the known art.

SUMMARY OF THE INVENTION

Accordingly, it is an object of the present invention to provide a kit, system and apparatus for use in concealing a hunter or naturalist in an outdoor environment, to inhibit detection of the user by game animals and/or other wildlife.

The present invention, in a first embodiment thereof, provides a kit and system for providing concealment to a user, including one or more shield members employing a camouflage covering, designed to blend in to a natural environment, and related support structure. Each shield member is independently adjustable, allowing a user thereof to position and arrange it to obscure or block an outside view of the user. One or more shield members can be attached to an outdoor observation structure selected from any number of alternative outdoor hunting or observation platforms. Non-limiting examples of observation structures with which the apparatus and system hereof is usable include boats, tree stands, ladder stands, ground enclosures, and hunting chairs.

A kit and system according to the first embodiment hereof includes a masking panel, a panel support frame including a hub and strut tensioning apparatus, an adjustable mounting arm, and one or more mounting supports.

The masking panel employs a camouflage design pattern for concealment, and may be provided with a three-dimensional structure, including cut away and/or add-on portions configured to simulate leaves, twigs, moss, and/or other nature effects. Three-dimensional camouflage provides for effective concealment, because it not only breaks up the outline shape of the panel structure, but it also provides a high effective level of outward visibility from the vantage point of a user located behind the panel. Multiple camouflage designs could be created as interchangeable fabric covers for the shield members, to provide seasonally appropriate concealment. The fabric cover is temporarily attached to the panel support frame, and is removable therefrom, so that a desired camouflage pattern can be quickly applied or changed.

Various panel shapes may be provided, in order to accommodate any number of concealment needs. A square panel provides for a simple and effective design, though any polygonal shape would suffice. For whichever shape is chosen, a strip of strong, flexible material extends around the perimeter, and this strip may be formed from a woven strap material. This perimeter strip is attached to the masking panel fabric. Each corner of the panel is provided with a pocket for receiving an end of a post of the panel support frame component of the system. These pockets may be sewn, riveted or otherwise fastened to the strap material at the perimeter of the panel.

During use and when in the deployed position thereof (shown in FIG. 1), the fabric masking panel of the system is attached to and supported by a panel support frame, including a hub and strut apparatus. The panel support frame used in the present invention is somewhat similar to the type of panel support frame used in a folding umbrella, but with fewer support struts used. A strut is provided corresponding to each corner of the panel, and all of these struts are pivotally attached to a central hub. The embodiment shown in the drawings uses four struts. The length of a strut should be slightly greater than the straight-line distance from the hub location to the corresponding corner of the panel fabric. In this arrangement the struts flex outwardly into a mild bow shape, and provide tension to the panel fabric, when the panel support frame is in its open, deployed position.

A central hub is provided to interconnect the struts, and to provide structure for attaching the struts to an end of the connecting arm. Hubs are available in a variety of designs. A first embodiment of a suitable hub is made of molded metal, or of a strong plastic or elastomer. The hub according to the first embodiment has a modified cylindrical or block shape, with a plurality of specific channel cutouts formed therein, extending radially outwardly from a central portion of the hub. A channel cutout is provided to accommodate each strut.

The channel cutouts are cut into a surface of the hub intended to face outwardly during use, and extend radially out through a side wall of the hub. The strut may attach directly to the hub by way of a pin, or an end cap flexibly attached to the hub may receive an end of a strut. A hub with channels forces the struts to extend out at a specific or predefined orientation in the deployed support structure.

An alternative design for the hub eliminates the channels by employing a flat, circular metal plate or similar element, rather than a molded cylindrical element. Such a hub uses a braided metal cable woven through holes in the hub and in the strut ends or end caps, to allow the struts to extend out at non-predefined radial angles. This simplified design also reduces manufacturing costs, because drilling the attachment holes is less costly than molding the channels. Furthermore, this hub design provides for a greater flexibility in panel design. As a result of not being constricted to predefined angles, the same hub and strut support apparatus can be used with fabric panels of varying shapes.

The concealment system hereof is capable of being used in connection with virtually any outdoor observation platform. Such a platform includes, but is not limited to a boat, ground enclosure, tree stand, ladder stand, or hunting chair. A ball mount is attached to the platform to be concealed by the panel, or may be separately attached to an adjacent support substrate, such as, e.g., a tree on which the platform is mounted. The ball mount can be attached by any suitable attachment mechanism. Screw holes may be provided at the base of the ball mount to facilitate attachment. The ball mount could be a solid piece of molded plastic, or alternatively, it could include a metal ball head integrally formed with a supportive neck and attachment structure. Alternatively, the ball mount could contain a threaded auger-type mounting stud, or could be attached to a screw-in type tree step. No matter which hub design is employed, a ball mount is attached to the hub on a surface opposite the surface where the struts are attached.

The kit and system hereof also includes a positioning arm with an independently adjustable mounting clamp at each end. The positioning arm according to one embodiment of the invention employs a bar that spans the arm from end to end. The bar may be a solid, integral unit or may include interconnected telescoping tubes. An independent, manually operated socket clamp is attached to each end of the bar. The socket clamps on the ends of the bar may be identical to one another, because a symmetric design allows for the greatest versatility and ease of use. Additionally, nearly any angle of concealment can be achieved by having this type of ball-and-socket joint on each end of the system. As each socket clamp has a separate tightening mechanism, the angle of attachment of the clamp to each ball mount can be independently adjusted.

The present invention also encompasses a method of concealing a user through the use of a number of independent masking panels.

For a more complete understanding of the present invention, the reader is referred to the following detailed description section, which should be read in conjunction with the accompanying drawings. Throughout the following detailed description and in the drawings, like numbers refer to like parts.

The present invention is not limited to its application to the details of construction and to the dispositions of the components set forth in the following description or illustrated in the drawings. The present invention is capable of other embodiments and of being practiced and carried out in various ways. In addition, it is to be understood that the phraseology and terminology employed herein are for the purposes of illustration and example, and should not be regarded as limiting.

As such, those skilled in the art will appreciate that the concepts upon which this disclosure is based, may readily be utilized as a basis for the designing of other structures, methods and systems for carrying out the several purposes of the present invention. It is important, therefore, that the claims be regarded as including such equivalent constructions.

DETAILED DESCRIPTION

Overview

FIG. 1 illustrates a tree stand 11, as one example of an observation platform on which a concealment apparatus 10, according to the present invention, can be mounted. The tree stand 11, per se, does not constitute part of the present invention, but rather, provides a substrate on which the system and apparatus 10 hereof may be mounted. The masking system and apparatus 10 hereof is particularly adapted for use by hunters, naturalists and photographers in combination with an outdoor observation station such as, for example, a tree stand 11, a ladder stand, a boat, a hunting chair, or a similar observation stand. Alternatively, the apparatus may be mounted to a tree, to provide a temporary blind.

Figure 1A:
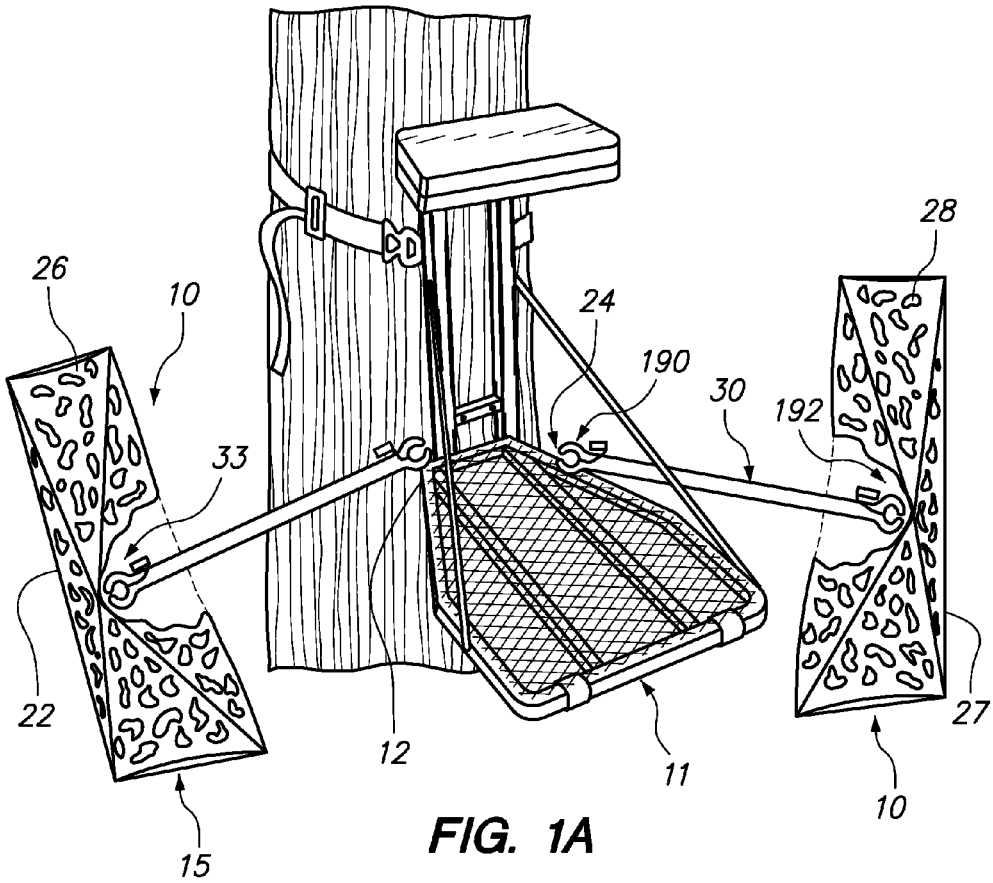
FIG. 1A is a perspective view of a tree stand having a camouflage cover system hereof installed thereon, with plurality of shield members attached to the tree stand according to a first illustrative embodiment of the present invention, and in which part of the blind panels are cut away to show a related support structure.

A pair of identical, adjustably positionable concealment apparatus 10, 10, according to a first illustrative embodiment of the present invention, are shown attached to the tree stand 11 in the drawing. As shown in FIGS. 1-2B, in a fully deployed configuration thereof, the masking system and apparatus 10 according to the selected embodiment includes a masking assembly 15, a positioning arm 30, and a ball mount 24, which is provided for attaching to a substrate and for supporting the shield member via the positioning arm. The masking assembly 15, in turn, includes a panel support frame 40, and a masking panel (shield member) 20 removably attached to the panel support frame. The positioning arm 30 is provided for placement extending between the ball mount and a hub portion of the masking assembly 15.

The system hereof includes, at a minimum, at least one adjustably positionable concealment apparatus 10. It will be understood, however, that a user is not limited to using a single adjustably positionable concealment apparatus 10 with a tree stand or other hunting platform, but that a user may choose to use two, three, four or more independently positionable concealment apparatus 10 together, in a coordinated fashion, to shield the user from view from a plurality of angles or directions.

Shield Member

Figure 2A:
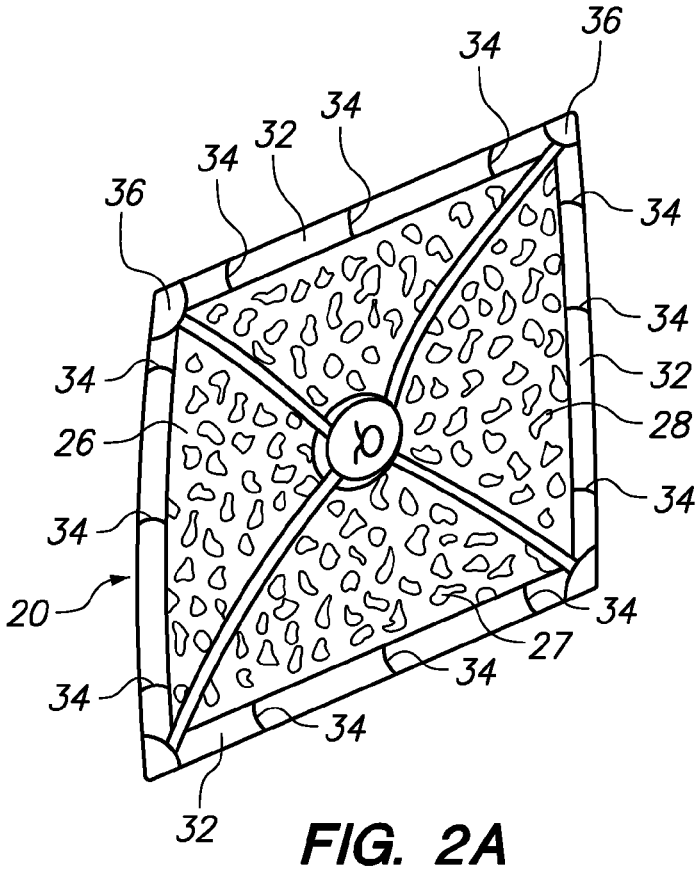
FIG. 2A is a perspective view of an inside surface of a shield member according to the first embodiment.
Figure 2B:
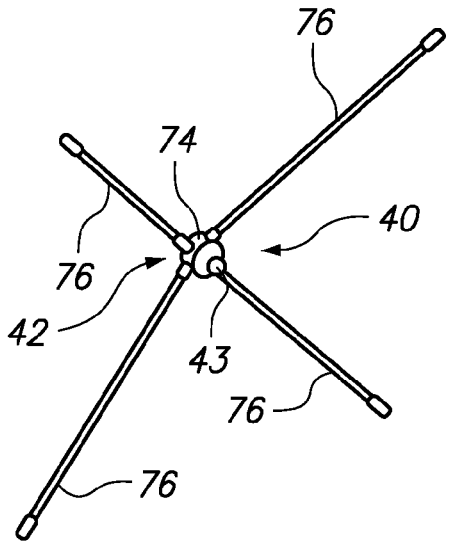
FIG. 2B is a perspective view similar to FIG. 2A with a fabric panel removed, showing only the panel support frame for the shield member.
Figure 3A:
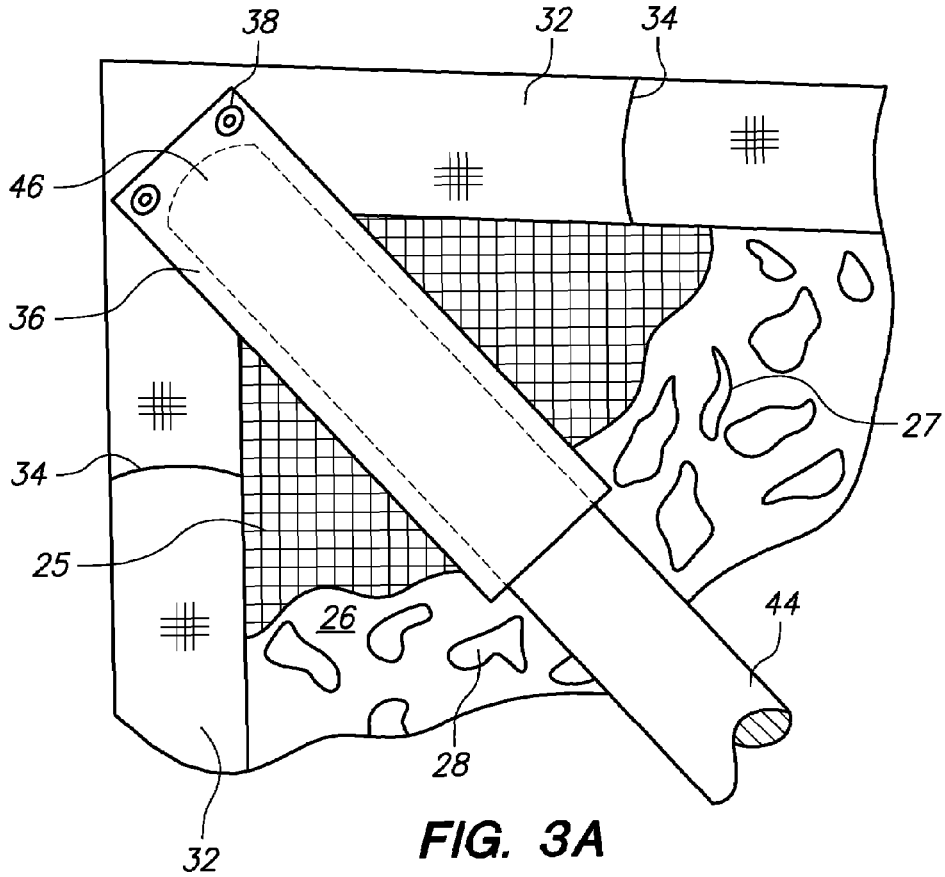
FIG. 3A is a detail plan view of an inside corner surface of the shield member of FIG. 2A, showing perimeter webbing and a pocket.

As noted above, the masking assembly 15 includes both the masking panel 20 and the panel support frame 40, which is provided for supportively holding the masking panel. Referring now to FIGS. 2A, 2B, and 3A, it will be seen that the masking panel (shield member) 20 is cooperatively supported by and overlies the panel support frame 40. The masking panel 20 provides the actual concealment by being positioned in the line of sight extending between the subject being observed and the user. The masking panel 20 includes a main panel portion 22, which is formed of a flexible fabric or sheet material having a camouflage pattern on the outwardly facing side. The illustrated embodiment of the masking panel 20 employs three-dimensional camouflage that includes an optional inner screen or mesh layer 25, and an outer camouflage sheet 26, which is stitched, removably fastened, or otherwise operatively connected to the mesh layer 25. Optionally, each of the inner mesh layer 25 and the outer camouflage sheet may be imprinted with a camouflage pattern thereon.

Figure 3B:
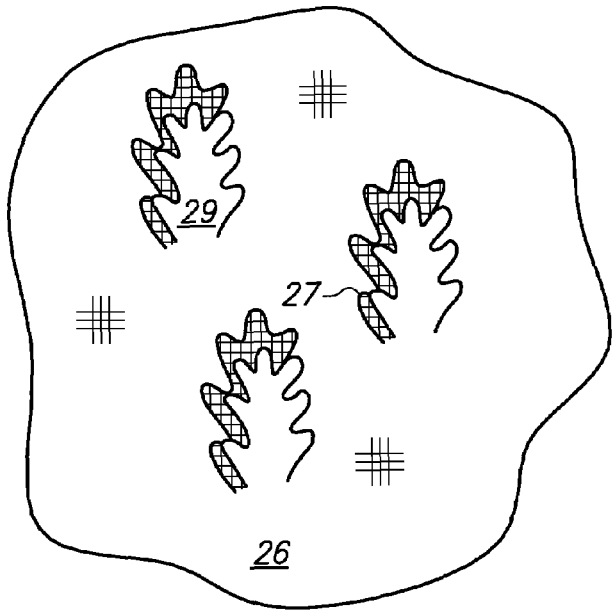
FIG. 3B is a detail perspective view of an exterior surface of the shield member of FIGS. 1-2A.

A pattern of incisions 27 and holes 28 is cut into the camouflage sheet 26, so that as shown in FIG. 3B, cutout elements 29 of the fabric may dangle off of the outer surface of the panel, to mimic a natural leafy effect. The incisions 27 and/or holes 28 also allow wind to pass easily through the masking panel 20, so that the panel does not act like a sail or kite to provide significant wind resistance.

The illustrated embodiment shows a substantially rectangular masking panel 20. However, it is within the scope of the invention to use a panel 20 having a circular or oval shape, a crescent shape, a regular polygonal shape, or any other desired shape. A high-strength, flat reinforcing strip 32 of material may be affixed to the inner mesh layer 25 along its outer edge. Such a material includes, but is not limited to nylon or other woven polymeric webbing. The reinforcing strip 32, where used, may be sewn to the camouflage sheet 26 or inner mesh layer 25, or may be removably attached to the sheet 26 or to the inner mesh layer using any suitable connector 34 such as ties, snaps, or a hook-and-loop fastener such as VELCRO™, so that different, possibly seasonal camouflage sheets may be attached and interchanged as needed. In the depicted embodiment, the reinforcing strip 32 at the perimeter of the masking panel 20 has pockets 36 affixed thereto, provided near each corner and aligned with a line extending between diagonally opposed corners. The pockets 36 may include reinforced support sockets. In the deployed position of the concealment apparatus 10, a significant amount of force is exerted on the masking panel 20 by the panel support frame 40. Accordingly, the pockets 36 may include rigid or semi-rigid plastic or metal sleeves, and rivets 38 may be used, if desired, to attach each of the pockets 36 to the reinforcing strip 32 at the corners of the masking panel 20.

The Panel Support Frame

While a number of different embodiments of support frames 40 are disclosed, the common elements of all embodiments include a central hub 42, a plurality of struts 44, which are each pivotally attached to the hub, and extend outwardly therefrom, and a ball mount 43, which is affixed to the hub 42. The embodiments differ in the hub construction. One embodiment includes a generally disc-shaped or cylindrical hub 74, while another embodiment includes a circular hub plate 45. The difference between the two embodiments is that in the first embodiment, the hub 74 may include guide channels as described in detail below.

Any suitable hub structure which is effective in a field situation could be used, such as, e.g. the hub structure described in U.S. Pat. No. 3,810,482, the disclosure of which is incorporated by reference. The hub disclosed in this reference would be modified, however, to fixedly and centrally attach a ball member to the side of the hub opposite the struts, in place of the handle described in the reference.

In the depicted embodiments, the hub 42 or 74 also includes a central ball 43 as a rigidly attached component thereof. The ball 43 faces inwardly in the deployed configuration of the panel support frame 40. The ball 43 is provided for insertion into a first socket clamp of the positioning arm 30, as will be subsequently described.

In the illustrated embodiment, four struts 44 of equal length are provided for each hub 42,74. However, it is within the scope of this invention to provide a hub having a fewer or greater number of struts, or to include struts of different lengths. The number of struts 44 should correspond to the number of corners. The shape of the masking panel 20 and the position of the corner pockets 36 determine the radial angle at which each strut 44 extends out from the hub 42.

The struts 44 can be made from any strong, semi-flexible fiberglass, plastic, metal, or composite material. In the depicted embodiment, each distal strut end 46 is covered with a plastic or elastomeric end cap to protect the pocket 36.

While the size of the masking panel 20 is not critical, the relationship between the distance from one corner to the diagonally opposed corner, compared to the distance between the ends of two diagonally opposed frame strut ends 46 is important. When the hub 42 is positioned in the center of the masking panel 20, and the struts are unbowed, the distal ends 46 of the struts extend out past each corner pocket 36.

Figure 1B:
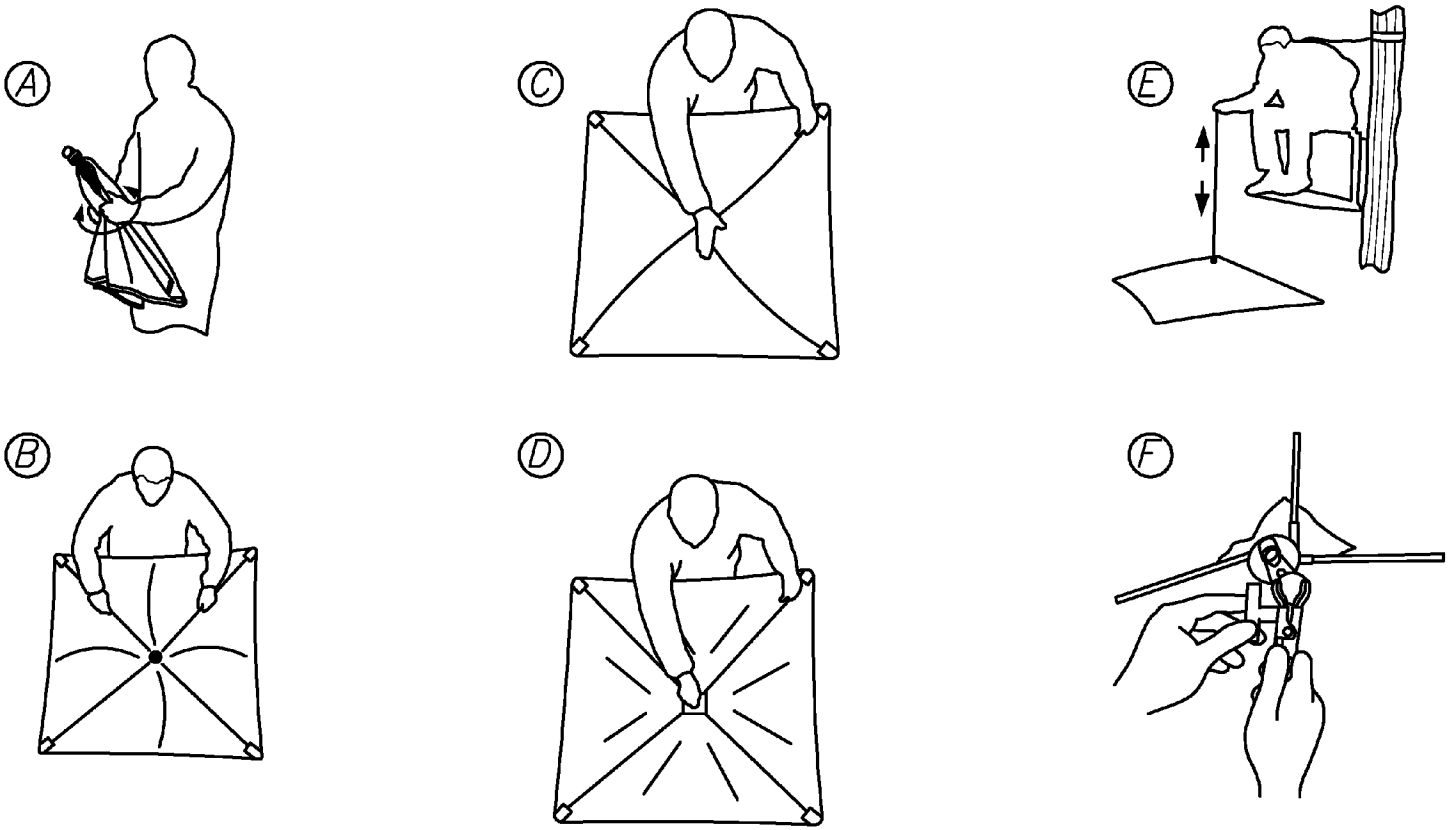
FIG. 1B pictorially illustrates a sequence of steps which can be followed in installing a shield member according to the illustrative embodiment on a tree stand.
Figure 1C:
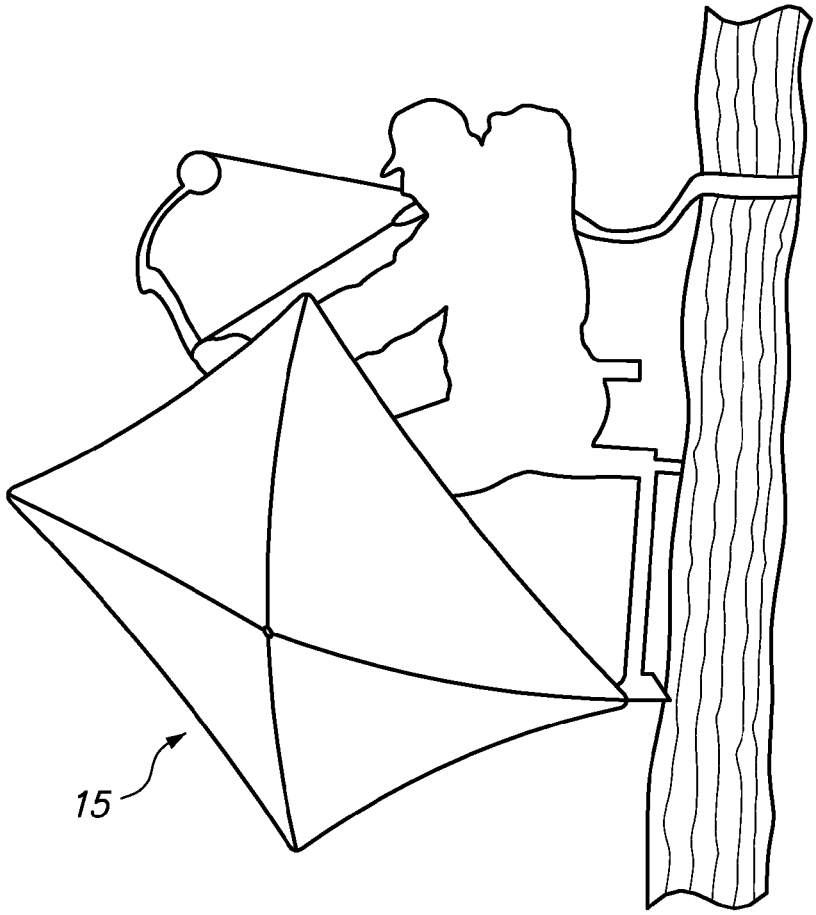
FIG. 1C is a perspective outline view showing a hunter seated on a tree stand and being partially masked by a shield member.

A sequence of steps which may be followed in unfolding, assembling and installing a masking assembly 15 on a tree stand is illustrated pictorially in FIG. 1B. The masking assembly 15 is shown in a folded or collapsed configuration in FIG. 1B(A), and the subsequent unfolding, deployment and mounting thereof is shown in FIGS. 1B(B)-1B(F). In order to connect the masking panel 20 to the panel support frame 40, the frame hub 42 must be raised off of the plane of the masking panel 20. This allows the struts 44 of the frame to angle downward toward the corner pockets 36. After inserting each strut end 46 into its corresponding corner pocket 36, the frame 40 and panel 20 take the form of a modified 4-faced pyramid with the masking panel 20 as the base. To deploy the masking panel 20, the frame hub 42, 74 needs to be pushed outwardly, or toward the plane of the panel, while the strut ends 46 are simultaneously pulled inwardly, in an opposite direction of the hub movement. When sufficient pressure is applied, this will stretch the material of the panel 20 and will move the outer ends of the struts 44 in past the hub 42, 74, causing the masking panel 20 to snap to an inverted pyramidal shape, or to a configuration somewhat resembling an open umbrella, as shown in FIGS. 1A, 1C, and 2A. The struts 44 will then be bowed outwardly, and thereby provide tension to keep the masking panel 20 taut on the panel support frame.

Traditional Hub with Additional Strut Stabilizing Insert

Figure 4:
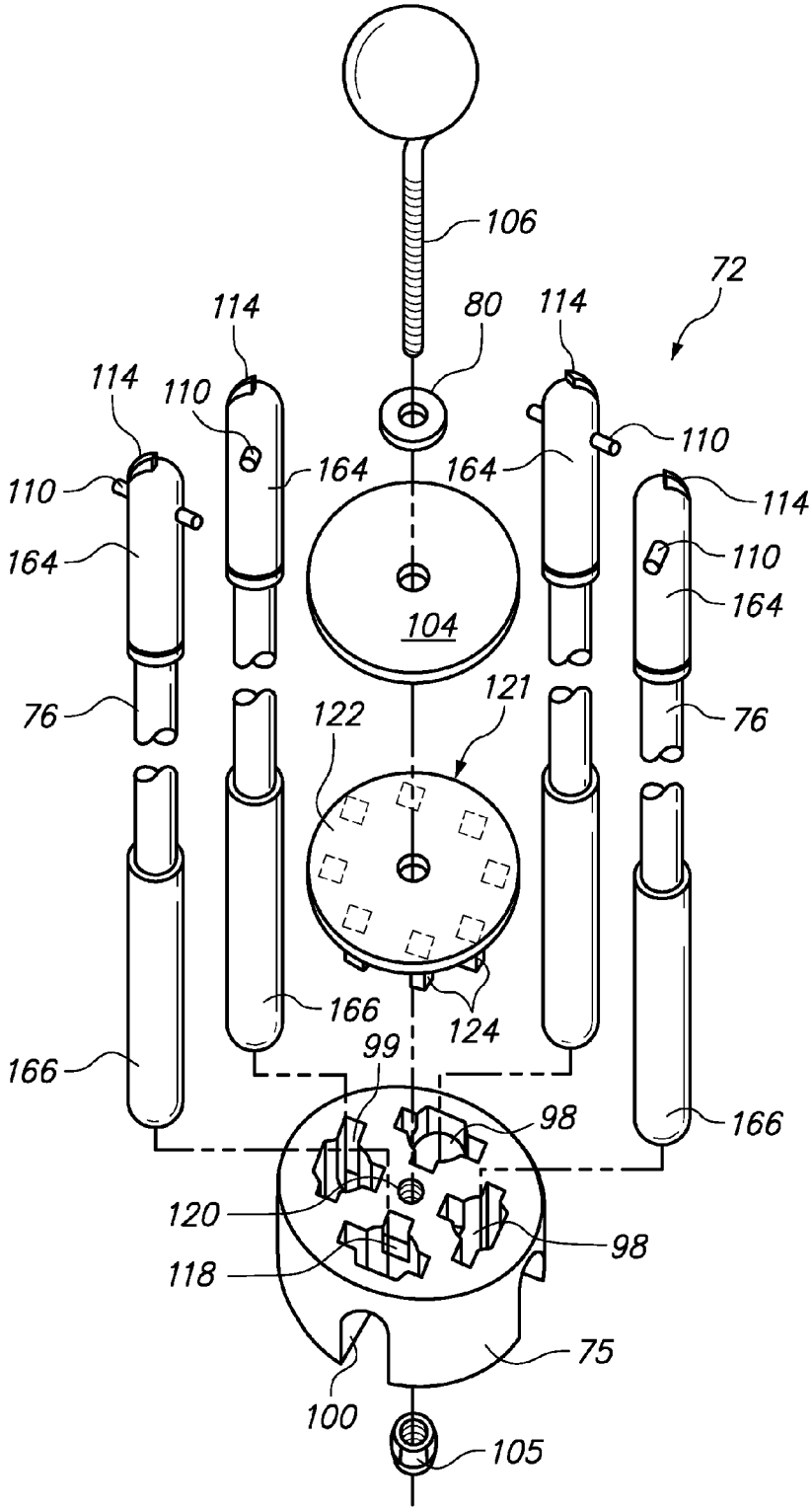
FIG. 4 is an exploded perspective view of the panel support frame of FIG. 2B, showing the hub and strut structure thereof with the struts thereof shown partially cut away.
Figure 5:
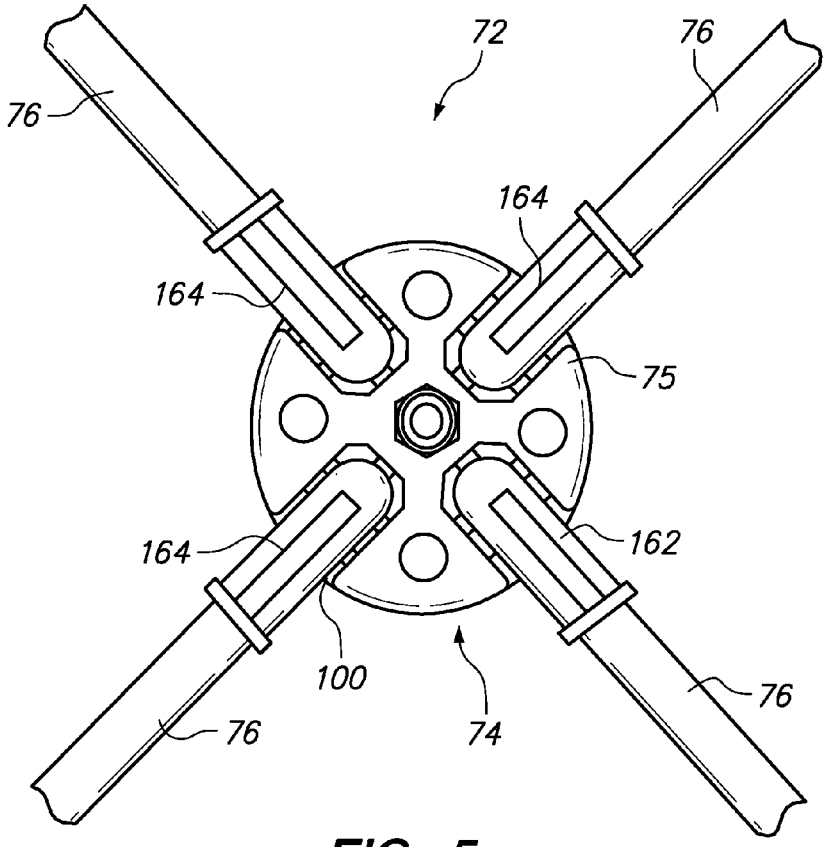
FIG. 5 is a side plan detail view of the assembled panel support frame of FIG. 2B, showing an outwardly-facing side thereof in a deployed configuration and with the struts thereof shown partially cut away.
Figure 6:
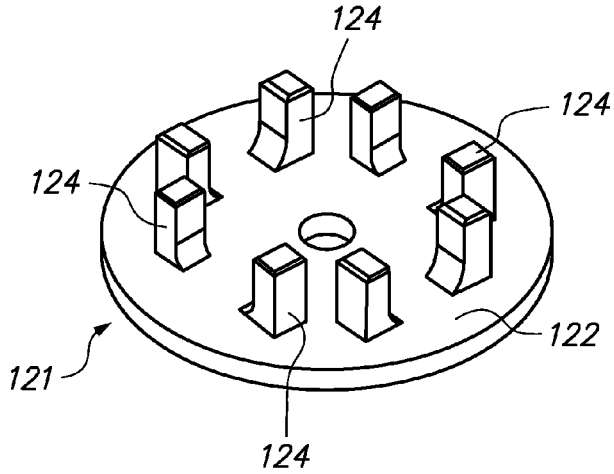
FIG. 6 is a detail perspective view of a strut stabilizer which is a component part of the panel support frame of FIG. 4.

A detailed view of a first illustrative embodiment of the support frame 40, 72 is depicted in FIGS. 4 and 5. As described above, the support frame 40, 72 includes a central hub 74 with struts 76 extending therefrom. The central hub 74 is made of a hard molded material such as plastic or metal. Four struts 76 extend out from the hub 74. Each strut 76 has a proximal end, for placement near the hub, and an outer or distal end. A proximal end cap 164 covers the proximal end, and a distal end cap 166 covers the distal end. The proximal end caps 164 include opposed pins 110 extending outwardly from side portions thereof, and a protruding ridge or stop member 114. The pins 110 engage the hub and allow the struts to pivotally swing while the protruding ridge 114 acts as a stop member to limit the allowed range of travel in the swinging motion.

The hub 74 includes a main hub body 75 which is substantially cylindrical in exterior shape, with opposite first and second surfaces and a sidewall extending therearound. Guide channels 100 are formed in the second surface of the main hub body, to respectively accommodate the struts 76, and these guide channels extend radially out to the sidewall. A plurality of strut insertion through holes 98 are formed through the main hub body 75 extending axially from the first surface to the guide channels 100, to facilitate the connection of the struts 76. These strut insertion holes 98 communicate with shallow pin guide channels 99 formed in the first surface of the main hub body, that receive and engage the end cap pins 110. A braking surface 118 that engages the protruding ridge 114 is also formed in the main hub body for each of the strut insertion holes 98. A center hole 120, which may have female threads formed therein, is cut through the center of the main hub body 75.

A ball mount 43 is fixedly attached to an outer end of a threaded stud 106. The stud 106 passes through a washer 80, a flat hub cap 104, a strut stabilizer 121, and the threaded center hole 120, and is secured with a nut 105 on the second surface of the hub.

The strut stabilizer 121 limits movement of the struts 76 in the hub insertion holes 98, and also applies pressure to the end cap pins 110, thereby stabilizing the struts 76. The strut stabilizer 121 includes a circular plate 122 formed of molded plastic that has a plurality of integrally formed pin-engaging protrusions 124 on one side thereof. There are two protrusions 124 for each strut, with one protrusion 124 provided for each pin 110. The protrusions 124 are molded to interlock with the pin guides 99 of each strut attachment hole 98, to contact the pins 110, and to limit movement of the pins in the hub assembly. The hub cap 104 acts as a large reinforcing washer and evenly distributes the pressure of the nut to the strut stabilizer 121.

Plate and Cable Based Hub

Figure 7:
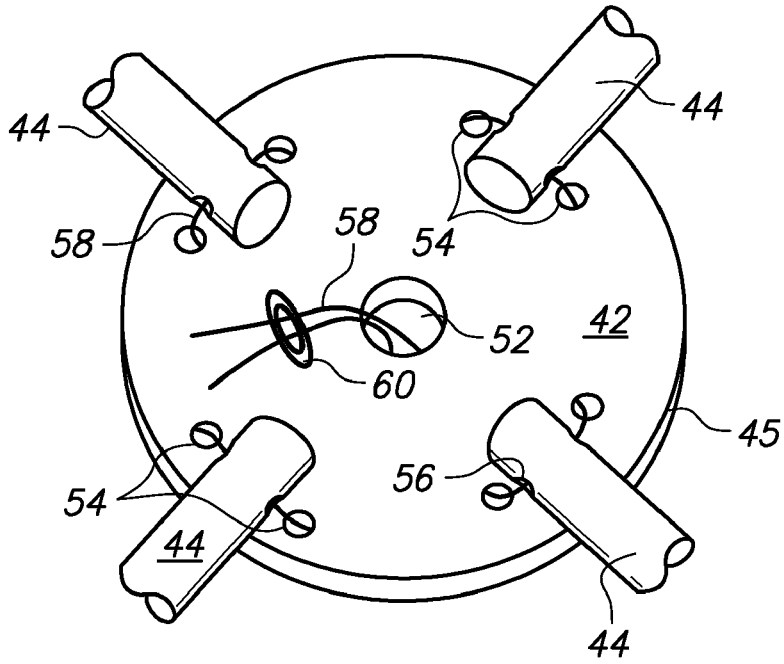
FIG. 7 is a perspective view of an alternative hub and strut support structure usable with a second embodiment of the present invention, with the struts thereof shown partially cut away.

FIG. 7 demonstrates another embodiment of a simplified hub 42 that includes a circular metal hub plate 45 having a top and bottom surface. There is a hole 52 in the center of the hub plate 45, as well as pairs of spaced-apart perimeter holes 54 disposed about the perimeter thereof. There will be a pair of perimeter holes 54 for each strut 44. Each pair of perimeter holes 54 is spaced an equal distance from the next pair, and the distance between two holes that form a pair is slightly greater than the width of a strut 44. Each strut 44 has an attachment hole 56 formed through one end thereof, transverse to the longitudinal axis of the strut, for attaching it to the hub 42 with cabling 58. A spherical metal ball, similar to the ball 43 shown in the embodiment of FIG. 4, is rigidly attached to the metal plate of the hub 42, on a side thereof opposite the struts 44. The ball may be attached by welding or other suitable method.

A strong braided metal cable 58 is fed through the center hole 52 from the top surface to the bottom surface. Next it is fed through a perimeter hole from the bottom surface to the top surface. The cable 58 then passes through the attachment hole 56 in the end of one of the struts 44. The cable 58 then passes through the next adjacent perimeter hole from the top surface to the bottom surface. This sequence is repeated until the desired number of struts 44 is attached. The cable 58 is then formed into a loop, by passing it back through the center hole 52 and fastening it to itself with a fastener 60.

Plate and Cable Based Hub Including Crimped Endcaps

Figure 8:
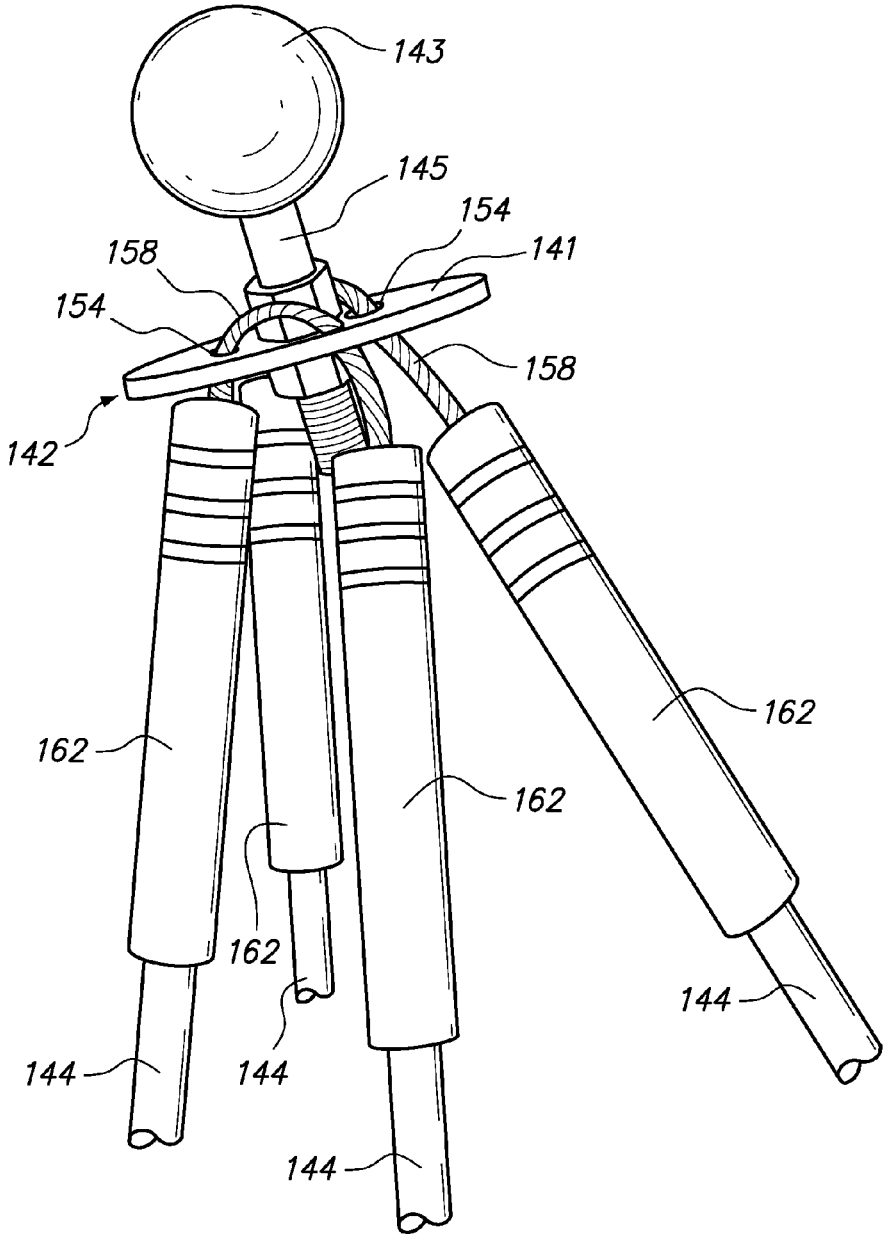
FIG. 8 is a perspective view of another alternative hub and strut support structure usable with a third embodiment of the present invention, with the struts thereof shown partially cut away.

FIG. 8 demonstrates a third embodiment of a simplified hub 142 that includes a circular metal plate 141 having a top and bottom surface. This third embodiment is again provided with a plurality of struts 144, and in this embodiment, each strut 144 is fitted with a metal endcap 162 that has an open strut receiving end, and a crimped end that fixedly receives an attachment cable 158. Unlike the previous embodiment that used a single loop of cabling, this embodiment employs multiple strands of cabling. In this embodiment, the hub plate 141 includes a single cabling hole 154 corresponding to each strut 144. In the disclosed embodiment there are four struts 144, four cabling holes 154 in the hub plate 141, and two strands of cable 158. Each end of a strand strong braided metal cable 158 respectively passes from the bottom surface through two adjacent cabling holes 154 to the top surface. An endcap 162 is crimped onto each cable end. The hub 142 includes a central hole that receives a stud 145 with a ball mount 143 fixedly attached thereon. The stud 145 is secured with a washer and nut combination.

Plate and Cable Based Hub Including Threaded Endcaps

Figure 9:
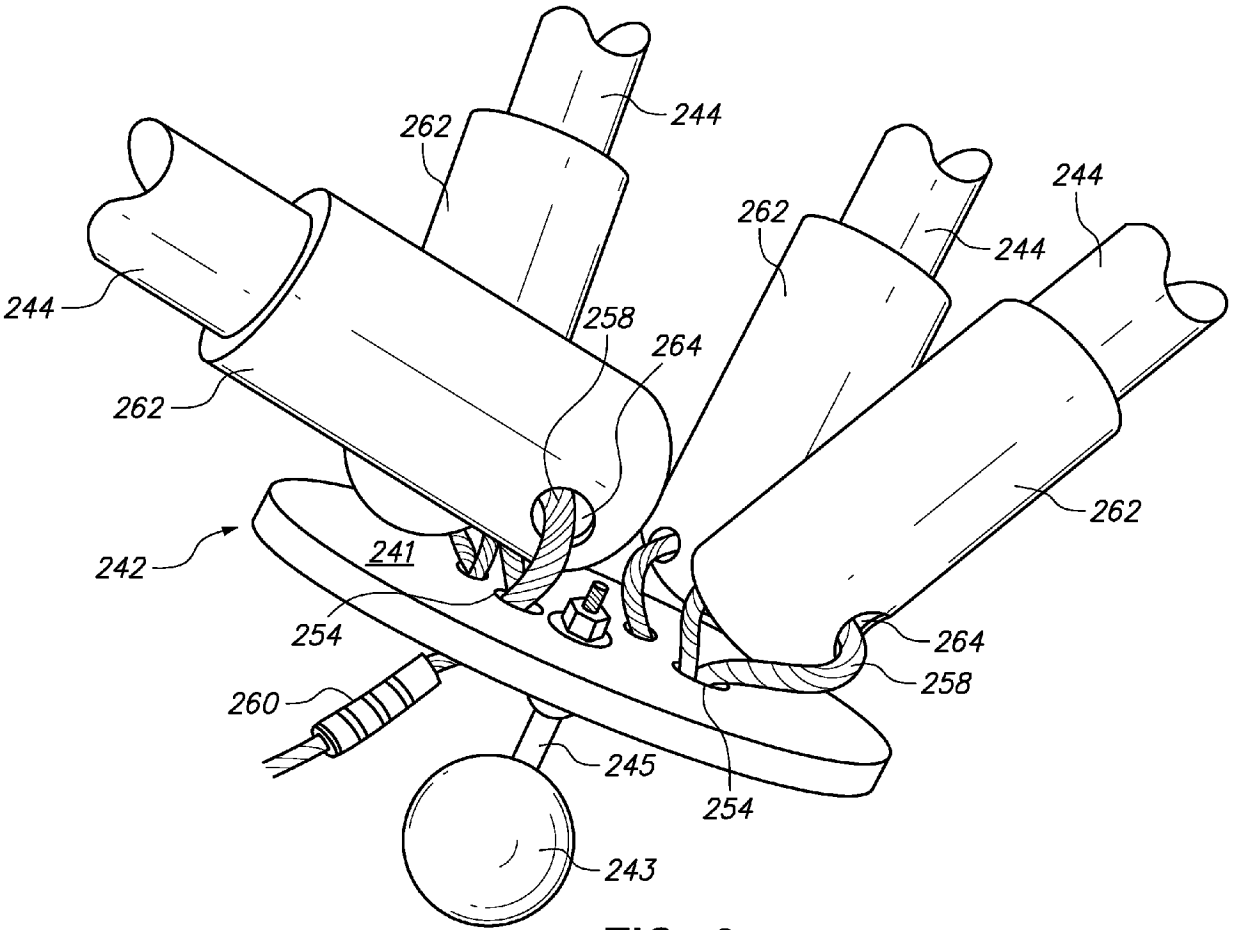
FIG. 9 is a perspective view of still another alternative hub and strut support structure usable with a fourth embodiment of the present invention, with the struts thereof shown partially cut away.
Figure 10A:
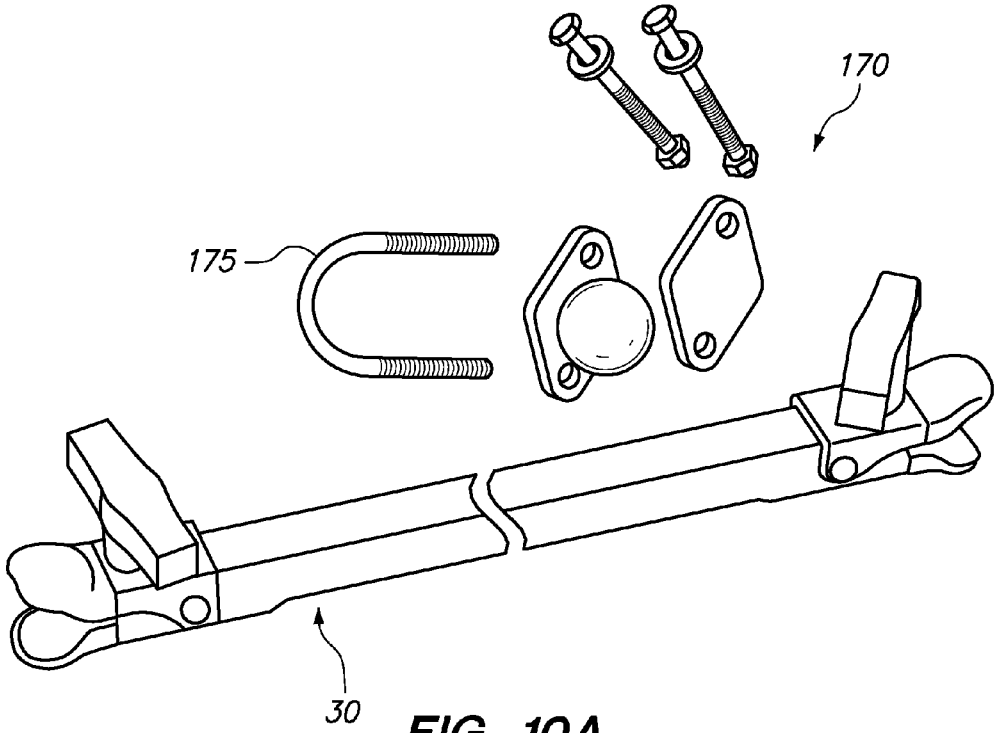
FIG. 10A is a perspective detail view of a ball mount kit and a positioning arm according to the present invention.
Figure 10B:
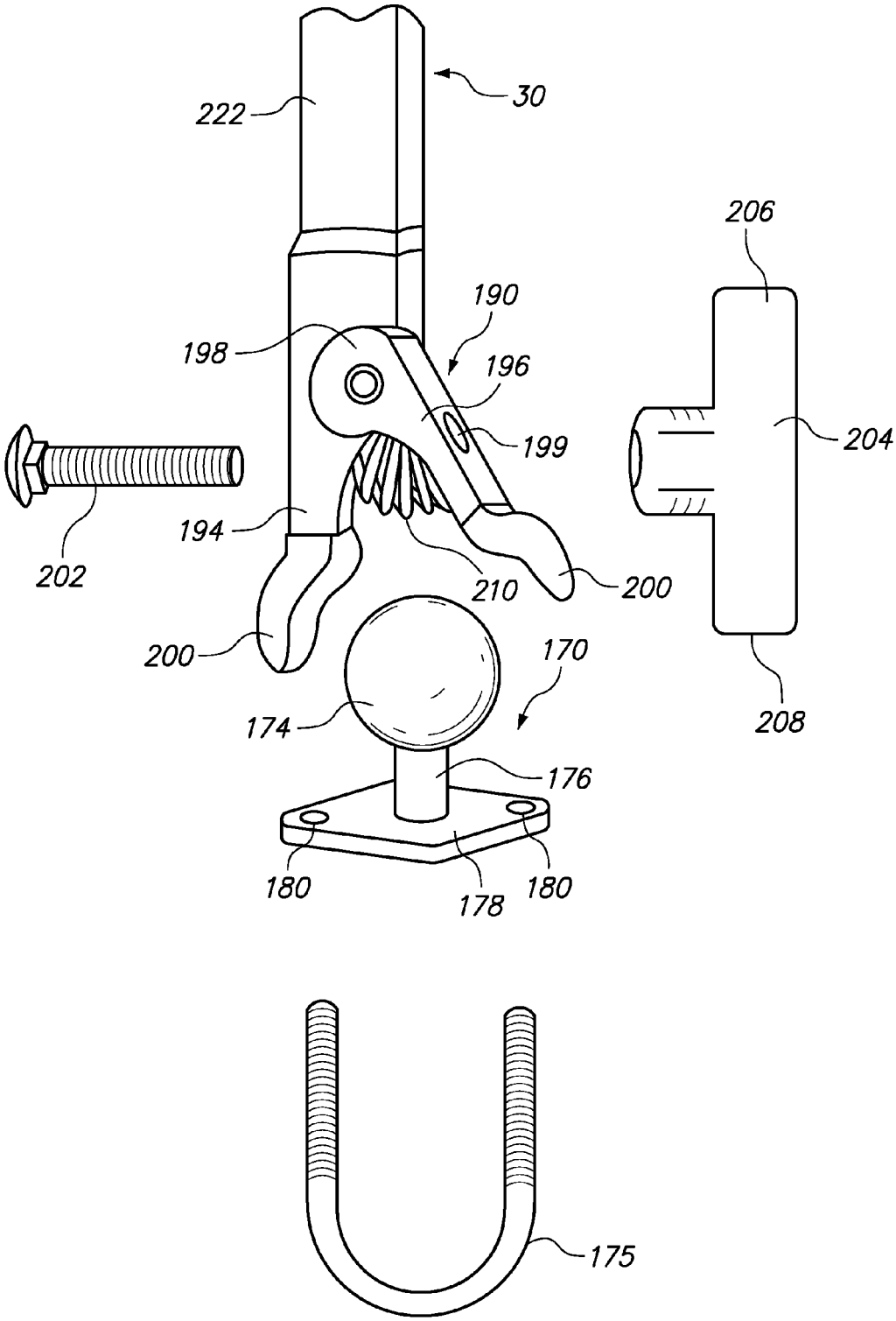
FIG. 10B is an exploded perspective detail view, partially cut away, of the ball mount and one end of the positioning arm of FIG. 10A.
Figure 10C:
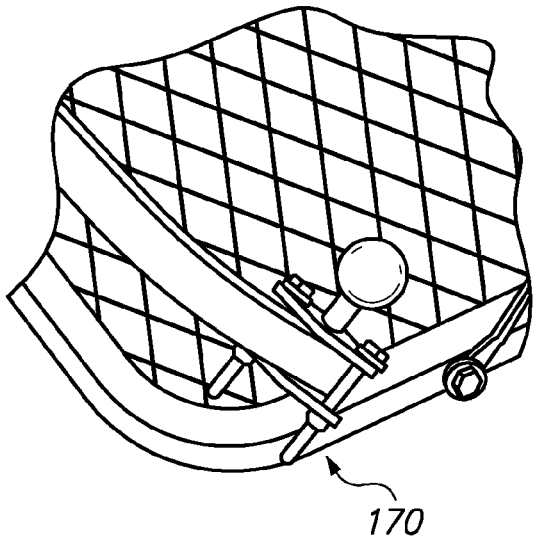
FIGS. 10C-10D are alternative environmental views showing installation of the ball mount of FIG. 10A on a tree stand.
Figure 10D:
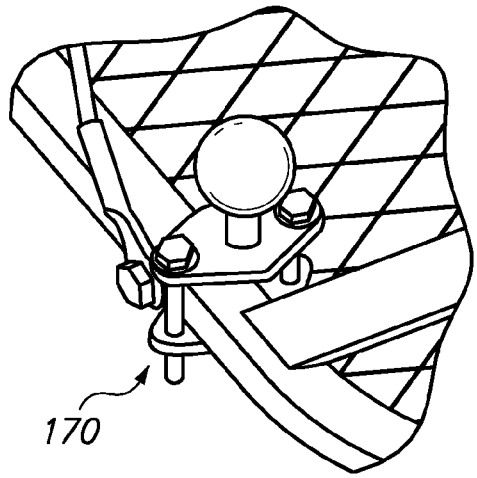

FIG. 9 demonstrates a fourth embodiment of a simplified hub 242 that includes a circular metal plate 241 having a top and bottom surface. Each strut 244 is fitted with a metal endcap 262. Each endcap 262 includes an attachment hole 264 formed transverse to the longitudinal axis of the strut 244, for attaching it to the hub 242 with cabling 258. The hub plate 241 includes a single cabling hole 254 corresponding to each strut 244. In the disclosed embodiment there are four struts 244 and four cabling holes 254. A strong braided metal cable 258 passes from bottom surface through a cabling hole 254 to the top surface. Next the cable 258 passes through an end cap attachment hole 264, and then returns back through the same cabling hole 258 to emerge at the bottom surface. This process is repeated for each strut 244 such that the cable 258 returns to the bottom surface where it is fastened to itself with a crimped fastener 260. The hub 242 includes a central hole that receives a stud 245 with a ball mount 243 fixedly attached thereon. The stud 245 is secured to the hub plate 241 with a washer and nut combination.

Ball Mount

Referring now to FIG. 10, a particular embodiment of a ball mount 170 is shown, along with an end portion of a positioning arm 30. The ball mount 170 is provided for attachment to a tree, tree stand, or other support. The ball mount 170 can be formed from a single piece of molded plastic or metal, or alternatively, can comprise a ball 174, a threaded stud 176 formed integrally with the ball, and a base 178. The size of the ball 174 may vary, as desired, but may be in a range from about one-half inch to 1.5 inches in diameter, for example. The base 178 of the ball mount should include holes 180 to facilitate the attachment of the ball mount to a particular platform 12. In some applications, simple screws or nuts and bolts may be sufficient to effectuate the attachment. In the illustrated embodiment, a U-bolt 175 may be employed to attach a ball mount 170 to a tree stand frame or similar support.

Positioning Arm

The positioning arm 30 includes a socket clamp 190, 192 at each end thereof, respectively, as shown in FIG. 1. The socket clamps 190, 192 at each end of the positioning arm 30 are substantially identical to one another, so only a single socket clamp 190 is shown in detail in FIG. 10. As best seen in FIG. 10, and as exemplified by socket clamp 190 in the drawing, each socket clamp includes an integral gripping element 194 and an adjustably movable gripping element 196 which is pivotally attached to the integral gripping element.

Each gripping element 194, 196 includes a base portion 198 and a concave, roughly hemispheric receiving section 200. Depending on the composition of the ball mounts 43, 74, it might be advantageous to coat the receiving sections 200 of the gripping elements in rubber, plastisol coating or similar material, to increase the friction of the grip. This coating, however, is not required in the practice of the present invention.

The integral gripping element 194 is formed integrally with the bar section of the arm, and the adjustably movable gripping element 196 is formed separately from the bar section, and is pivotally attached to the integral gripping element 194 by a rivet or similar fastener. The gripping elements 194, 196 can be made from metal or plastic or some combination thereof. Each of the gripping elements 194, 196 has a through hole 199 formed respectively therein to accommodate a bolt 202.

A spring 210 is provided extending between the gripping elements 194, 196 to bias them in an opening direction, and a handle 204, having a threaded nut embedded therein, is provided to attach to the bolt 202 and to allow manual tightening of the clamp 190. The handle 204 is substantially T-shaped and includes a pair of opposed, outwardly extending gripping sections 206, 208 to allow grasping by a user to easily turn the handle. The bolt 202 is fed through the through holes 199 of the gripping elements, and also passes through the center of the spring 210. Optionally, a wing nut (not shown) could be substituted in place of the handle 204.

As the handle 204 is loosened, the spring 210 around the bolt 202 forces the receiving sections 200 of the two gripping elements 194, 196 away from each other, in order to receive a ball mount 43, 174 therebetween. Similarly, once the ball mount 43, 174 has been received, the handle 204 is tightened to lock the socket clamp 190 on to the ball mount 43, 174, in order to temporarily fix the angle of attachment thereof.

Positioning Arm

The positioning arm 30 can be formed as a unitary span 222 of strong rigid material. Steel tubing or extruded aluminum tubing provides a good combination of strength and weight considerations. The positioning arm 30 may, alternatively, include two tubes arranged in telescoping relation, with a thumbscrew or similar fastener to lock the relative positions of the tubes. The illustrated embodiment shows an arm 220 where the integral gripping elements 194 of each socket clamp 190, 192 is permanently attached to respective ends of the arm span 222 by welding. Other mechanisms of attachment such as a rivet, or a screw mount could alternatively be used.

Figure 11A:
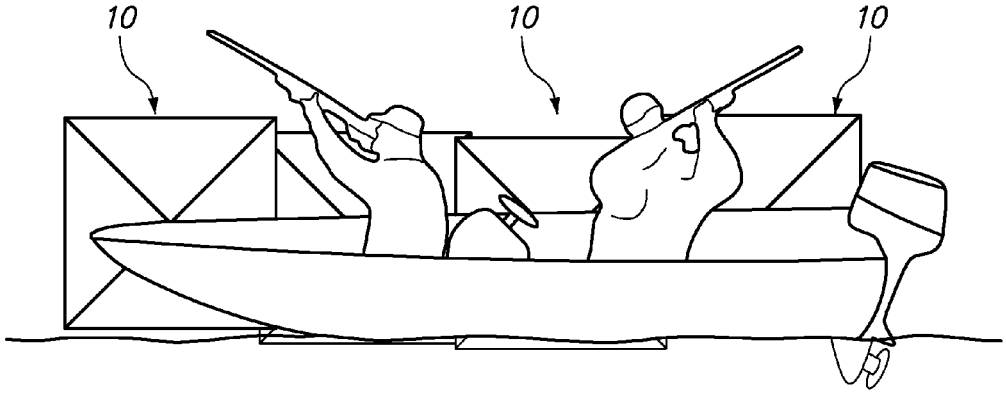
FIG. 11 is a perspective view of boat having a plurality of blind shield members attached thereto, in an alternative application of the masking system hereof.
Figure 11B:
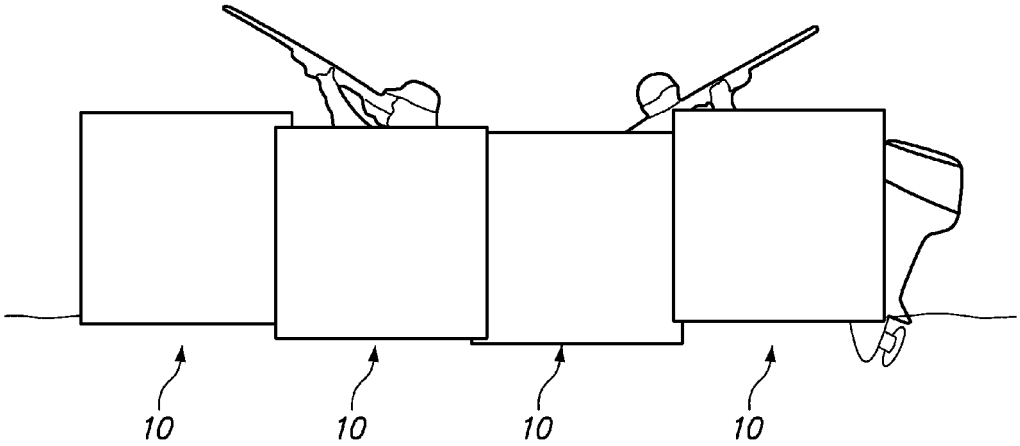
Figure 11C:
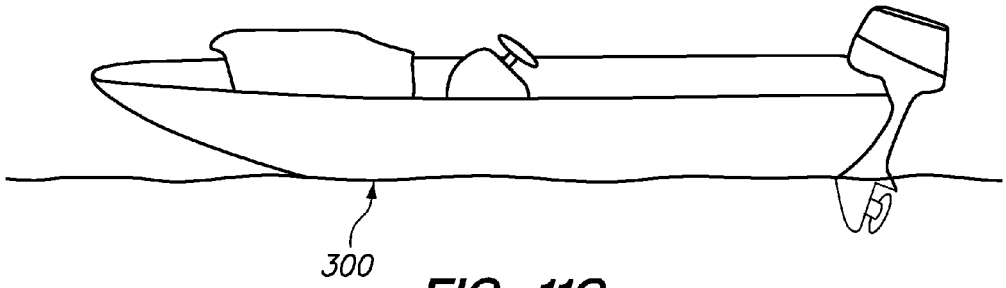

FIGS. 11A-11C illustrate an application of the system hereof to a boat 300. FIG. 11A shows four concealment apparatus 10 attached to a first side of the boat 300. FIG. 11B shows four concealment apparatus 10 attached to a second side of the boat 300 as an alternative application. FIG. 11C shows the boat 300 as it would appear without the concealment apparatus installed thereon.

Method

The present invention also provides a method of concealment. One non-limiting example of a method which may be used for concealing a hunter or other user is as follows:

Step 1. Provide a tree stand 12 or, alternatively, provide any other of many possible observation stations, as previously noted.

Step 2. Attach a ball mount 170 to a solid portion of the observation station such as to a tubular frame member of the tree stand 12. This may be accomplished by placing a U-bolt 82 around the frame member and then passing the threaded ends of the U-bolt through the mounting holes 180 on the base 178 of the ball mount 170.

Step 3. Prepare a masking panel 20 for deployment by choosing a suitable camouflage covering 26 and attaching it to a perimeter webbing 32 with ties 34.

Step 4. Attach the frame 40 to the masking panel 20 by inserting each strut end 46 into its own panel corner pocket 36.

Step 5. Deploy panel 20 by pressing the hub 42 toward the plane of the panel fabric 26 while simultaneously pulling one or more strut ends 46 in an opposite direction of the pushing motion.

Step 6. Attach the deployed panel 20 to the positioning arm 30 by loosening the handle 204 of the second socket clamp 192 and allowing the biasing spring 210 to spread the gripping elements 194, 196, position the hub ball 43 between the receiving sections 200 of the gripping elements 194, 196, angling the deployed panel 20 to a desired angle, and tightening the hand screw 204 so that the receiving sections 200 firmly grip the hub ball 43.

Step 7. Attach the positioning arm 30 to the ball mount 170 by loosening the handle 204 of the first socket clamp 190 and allowing the spring 210 to spread the gripping elements 194, 196, position the ball 174 between the receiving sections 200 of the gripping elements 194, 196, adjust the positioning arm 30 to a desired angle, and tighten the handle 204 so that the receiving sections 200 firmly grip the ball 174.

Step 8. Repeat all of the preceding steps as necessary with additional independent masking panels in order to provide a desired level of concealment.

Although the present invention has been described herein with respect to a number of specific illustrative embodiments, the foregoing description is intended to illustrate, rather than to limit the invention. Those skilled in the art will realize that many modifications of the described embodiment could be made which would be operable. All such modifications, which are within the scope of the claims, are intended to be within the scope and spirit of the present invention.

Having, thus, described the invention, what is claimed is:

1. A masking system for providing adjustably positionable concealment to a user thereof, said masking system comprising at least one independent masking assembly which is movable between a collapsed configuration and a deployed configuration, said masking assembly comprising:

a shield member comprising a sheet of flexible material, said shield member having an outer side with a camouflage pattern thereon, and an inner side opposite the outer side, said shield member comprising a plurality of peripheral strut-receiving portions;

a frame structure for supporting the shield member thereon, said frame structure comprising a hub and a plurality of resiliently flexible struts operatively attached to said hub and extending outwardly therefrom, wherein said hub comprises a main hub body and a first ball portion fixedly attached to the main hub body, wherein said main hub body, said struts and said first ball portion are disposed at the inner side of said shield member, and wherein said struts are dimensioned and configured to be bowed in the deployed configuration of said masking assembly in order to place tension on said shield member;

a ball mount for attaching to a support substrate, said ball mount comprising a second ball portion; and a positioning arm having a first end with a first socket clamp and a second end with a second socket clamp, wherein the first socket clamp is releasably attachable to the first ball portion on the hub, and the second socket clamp is releasably attachable to the second ball portion on the ball mount, and wherein the first and second socket clamps are operable independently of one another.

2. The system of claim 1, wherein said strut-receiving portions are disposed on the inner side of said shield member, and each of said peripheral strut-receiving portions comprises a pocket provided to receive a strut end therein.

3. The system of claim 1, wherein each of said first and second socket clamps comprises:

a first, integral gripping element, a second, adjustably movable gripping element, wherein each of said first and second gripping elements comprises a base portion and an outer end comprising a concave receiving surface, wherein the base portion of said movable gripping element is pivotally attached to the base portion of said integral gripping element, wherein said first gripping element and said second gripping element each have a hole formed medially therein between the base portion and the outer end thereof;

a coil spring disposed between said first and second gripping elements;

a bolt passing through said hole in said first gripping element, through said coil spring, and through said hole in said second gripping element, a portion of said bolt between said first gripping element and said second gripping element being surrounded by the coil spring, and a tightening member comprising a nut having threads formed internally therein, said nut being threadably attached to an end portion of said bolt.

4. The system of claim 3, wherein said frame structure comprises a plurality of struts extending from a central hub, the hub comprising a substantially circular plate having a first surface, a second surface, a center hole, and a plurality of cabling holes, each strut of said plurality of struts having two ends, a proximal end and a distal end, said proximal end having a metal endcap fixedly attached thereon;

said endcap having a strut receiving end and a crimped end, said crimped end fixedly attached to cabling, each of said endcaps attached to said plate proximate said first surface by said cabling being passed through selected ones of said cabling holes and said attachment hole, and wherein said first ball portion is operatively attached to said second surface.

5. The system of claim 1, wherein said shield member has a substantially polygonal shape with a plurality of corners and comprises a reinforcing perimeter strip which is operatively attached to the inner side of said sheet of flexible material, wherein a pocket is provided at each corner of the shield member, and wherein said sheet of flexible material provides a camouflage covering.

6. The system of claim 5, wherein said frame structure comprises a plurality of struts extending from a central hub, the hub comprising a substantially circular plate having a first surface, a second surface, a center hole, and a plurality of cabling holes, each strut of said plurality of struts having two ends, a proximal end and a distal end, said proximal end having a metal endcap fixedly attached thereon;

said endcap having a strut receiving end and a crimped end, said crimped end fixedly attached to cabling, each of said endcaps attached to said plate proximate said first surface by said cabling being passed through selected ones of said cabling holes and said attachment hole, and wherein said first ball portion is operatively attached to said second surface.

7. The system of claim 1, wherein said main hub body comprises a guide block having a first side, a second side opposite the first side, and a sidewall extending therearound, said guide block having central hole formed therethrough, said first side having a plurality of radially extending channels formed therein, said guide block also having a plurality of through holes extending therethrough in respective communication with said channels, said through holes having pin guides therein, said guide block further having a stop block extending outwardly in each of said channels;

wherein a respective one of said plurality of struts fits into each of said through holes so as to be capable of extending radially outwardly from said central hub in a deployed position of said frame structure, each strut of said plurality of struts having two ends, a center end and a distal end, said center end covered in a molded endcap, said endcap comprising two pins and a protruding ridge, each of said struts inserted into said through holes such that said pins engage said pin guides;

a strut stabilizer comprising a unitary molded circular plate having a first surface, a second surface, and a second central hole, said second surface having pin-engaging protrusions formed thereon, said protrusions configured to contact and stabilize said pin guides, said strut stabilizer inserted into said hub over said struts;

a hub cap comprising a circular plate with a third central hole, said hub cap placed over said strut stabilizer;

a threaded stud with a ball attached to an end thereof, said stud passing through said third, second, and first central holes and supportively receiving a nut thereon.

8. The system of claim 1, wherein said frame structure comprises a plurality of struts extending from a central hub, the hub comprising a substantially circular plate having a first surface, a second surface, a center hole, and a plurality of cabling holes, each strut of said plurality of struts having two ends, a proximal end and a distal end, said proximal end having a metal endcap fixedly attached thereon;

said endcap having a strut receiving end and a crimped end, said crimped end fixedly attached to cabling, each of said endcaps attached to said plate proximate said first surface by said cabling being passed through selected ones of said cabling holes, and wherein said first ball portion is operatively attached to said second surface.

9. A masking system for providing adjustably positionable concealment to a user thereof, said masking system comprising at least one independent masking assembly which is movable between a collapsed configuration and a deployed configuration intended for use, said masking assembly comprising:

a shield member comprising:

an external masking layer formed of flexible material, said external masking layer having an outer side with a camouflage pattern thereon and comprising a plurality of cut away portions configured to simulate leaves, and an inner side opposite the outer side;

a screen panel operatively attached to said masking layer and disposed adjacent the inner side thereof, a reinforcing perimeter strip which is operatively attached to the inner side of said screen panel; and a plurality of spaced-apart pockets attached to said perimeter strip to provide a plurality of peripheral strut-receiving portions;

a frame structure for supporting the shield member thereon, said frame structure comprising a hub and a plurality of resiliently flexible struts operatively attached to said hub and extending outwardly therefrom, wherein said hub comprises a main hub body and a first ball portion fixedly attached to the main hub body, wherein said struts are dimensioned and configured to be bowed outwardly in the deployed configuration of said masking assembly in order to place tension on said shield member, and said ball portion extends inwardly from the hub at the inner side of said screen panel in the deployed configuration of said masking assembly;

a ball mount for attaching to a support substrate, said ball mount comprising a second ball portion; and a positioning arm having a first end with a first socket clamp and a second end with a second socket clamp, wherein the first socket clamp is releasably attachable to the first ball portion on the hub, and the second socket clamp is releasably attachable to the second ball portion on the ball mount, and wherein the first and second socket clamps are operable independently of one another.

10. The system of claim 9, wherein the screen panel has a camouflage pattern thereon.

* * * * *